US006294945B1

(12) United States Patent
Regier et al.

(10) Patent No.: US 6,294,945 B1
(45) Date of Patent: Sep. 25, 2001

(54) SYSTEM AND METHOD FOR COMPENSATING THE DIELECTRIC ABSORPTION OF A CAPACITOR USING THE DIELECTRIC ABSORPTION OF ANOTHER CAPACITOR

(75) Inventors: Christopher G. Regier, Cedar Park; Clayton Daigle, College Station, both of TX (US)

(73) Assignee: National Instruments Corporation, Austin, TX (US)

( * ) Notice: Subject to any disclaimer, the term of this patent is extended or adjusted under 35 U.S.C. 154(b) by 0 days.

(21) Appl. No.: 09/496,566

(22) Filed: Feb. 2, 2000

(51) Int. Cl.[7] ..... G06G 7/19

(52) U.S. Cl. ..... 327/341; 327/336; 330/7; 330/273

(58) Field of Search ..... 327/50, 51, 52, 327/62, 336, 337, 341; 330/7, 67, 129, 261, 273

(56) References Cited

U.S. PATENT DOCUMENTS

| | | | | |
|---|---|---|---|---|
| 3,667,055 | * | 5/1972 | Uchida | 328/127 |
| 4,211,981 | | 7/1980 | Lerma | 328/127 |
| 4,651,032 | * | 3/1987 | Nobuta | 327/341 |
| 5,376,892 | * | 12/1994 | Gata | 327/73 |
| 5,519,328 | | 5/1996 | Bennett | 324/684 |
| 5,557,242 | | 9/1996 | Wetherell | 331/17 |
| 5,585,756 | * | 12/1996 | Wang | 327/341 |
| 6,064,238 | * | 5/2000 | Wight et al. | 327/58 |

* cited by examiner

*Primary Examiner*—Timothy P. Callahan
*Assistant Examiner*—An T. Luu
(74) *Attorney, Agent, or Firm*—Conley, Rose & Tayon PC; Jeffrey C. Hood

(57) ABSTRACT

A system and method, wherein the dielectric absorption of a capacitor is cancelled by a compensating circuit. One embodiment uses a compensation circuit comprising a compensating capacitor with substantially identical characteristics as the capacitor to be compensated in an integrator circuit. The effects of the dielectric absorption of the capacitor in the integrator circuit are reduced or eliminated because the dielectric absorption of the compensating capacitor cancels the dielectric absorption of the capacitor in the integrator circuit. Another embodiment uses compensation circuitry to reduce or eliminate the effects of dielectric absorption in any particular capacitor. The compensation capacitor in the compensation circuitry has a higher rate of dielectric absorption and a lower capacitance value than the capacitor whose dielectric absorption effects are to be reduced or eliminated. In another embodiment, the effects of the dielectric absorption of a capacitor are reduced or eliminated by choosing a compensation capacitor in the compensation circuitry with the same dielectric absorption as the capacitor to be compensated. The dielectric absorption of the compensation capacitor is scaled by the resistors in the compensation circuitry which determine the gain of the amplifier in the compensation circuitry.

37 Claims, 8 Drawing Sheets

SYSTEM AND METHOD FOR COMPENSATING THE DIELECTRIC ABSORPTION OF A CAPACITOR USING THE DIELECTRIC ABSORPTION OF ANOTHER CAPACITOR

BACKGROUND OF THE INVENTION

1. Field of the Invention

This invention relates to the characteristics of capacitors, and more particularly to methods for reducing or eliminating dielectric absorption error in circuits using capacitors.

2. Description of the Relevant Art

A capacitor comprises two parallel conductive plates separated by a dielectric. The dielectric may be composed of various types of materials. Dielectric absorption refers to the small amount of excess charge absorbed or released by a dielectric after a capacitor has been charged or discharged. Dielectric absorption is a property that every capacitor exhibits to differing degrees. The amount of dielectric absorption for a particular capacitor depends primarily on the type of dielectric material used and the amount of dielectric material in the capacitor. It is desirable to compensate for the effects of dielectric absorption to achieve a more ideal and predictable capacitance.

The effects of dielectric absorption can be seen when a known amount of charge is deposited on a capacitor and the voltage across the capacitor is then observed. The voltage will decay at a constantly decreasing rate, causing the voltage at any given time to be slightly below the level of voltage initially observed across the capacitor. It is believed that this lost charge is absorbed by the dielectric and is, therefore, not apparent in a voltage reading across the capacitor.

The effects of dielectric absorption may be seen by following the following procedure. First a battery is used to charge a large-value tantalum capacitor to a level of 10 volts. Next, after the capacitor is fully charged and has reached a voltage level of 10 volts, the battery is removed. At this point, the voltage across the capacitor should be 10 volts. Now the capacitor may be rapidly discharged by momentarily putting a 100 ohm resistor across it. The resistor is then removed. When the voltage across the capacitor is measured again, the voltage across the capacitor may be observed increasing in voltage, even though the capacitor was previously discharged. The voltage across the capacitor may perhaps reach a volt or so after a few seconds. Dielectric absorption is the cause of the voltage across the capacitor increasing in voltage despite the fact the capacitor was discharged.

Dielectric absorption typically is less than 1% of the total charge applied to a capacitor. Some applications are not substantially affected by this degree of error, but most applications encourage the removal of as much error as possible. Because dielectric absorption varies greatly depending on the type of dielectric used in the capacitor, one way to minimize dielectric absorption is by choosing a dielectric that is less susceptible to this absorption. An air dielectric capacitor, for example, has a very small absorption rate, but is very impracticable in most applications. Air dielectric capacitors are physically much larger (by orders of magnitude) and much more expensive than lower quality capacitors with similar capacitive ratings. Another potential solution is to allow sufficient time between charging periods to allow the current associated with dielectric absorption to drop to an acceptable level. Other methods of partially compensating for dielectric absorption have been used such as providing an "equivalent and opposite impedance" to the dielectric absorption in a capacitive load (U.S. Pat. No. 5,557,242) and using a series of RC circuits to compensate for dielectric absorption (U.S. Pat. No. 5,519,328). However, improved methods are desired for compensating the dielectric absorption error of a capacitor.

SUMMARY OF THE INVENTION

A system and method are provided for compensating for the effects of dielectric absorption on a capacitor. The system may include a compensation circuit which connects to a circuit portion having a capacitor (main capacitor) which is desired to be compensated, wherein the compensation circuit compensates for dielectric absorption of the capacitor in the circuit portion.

In a particular embodiment, compensation techniques are used to substantially reduce or eliminate dielectric absorption in an integrator circuit. In this embodiment, the compensation circuit is coupled to an integration circuit configured to generate a triangle wave. An input signal voltage such as a square wave is input to the compensation circuit. The compensation circuit uses a second capacitor, referred to as the compensation capacitor, which may have substantially identical characteristics to the main capacitor desired to be compensated, e.g. the capacitor in the integration portion of the circuit. The compensation capacitor is initially charged to the level of the input signal voltage, and then the input voltage is removed. The measured voltage across the capacitor may then exhibit the effects of dielectric absorption by sagging as its dielectric material absorbs energy from the conducting plates. The compensation capacitor is used to produce a voltage, referred to as the modified input signal voltage, approximately equal to the input signal voltage less the voltage lost, referred to as the dielectric absorption voltage, caused by the dielectric absorption of the compensating capacitor. The voltage lost by the compensating capacitor is approximately equal to the dielectric absorption voltage exhibited by the main capacitor being compensated. The modified input signal voltage is then subtracted from twice the input signal voltage resulting in a compensated input signal voltage. The compensated input signal voltage approximately equals the input signal voltage plus the dielectric absorption voltage. The compensated input signal is then passed through the integration portion of the circuit. Because the integration portion of the circuit contains a capacitor with similar or identical characteristics to those of the compensating capacitor, the effects of the dielectric absorption on the circuit's output signal are minimized. This compensation creates, for example, a triangle wave output that is more linear for a square wave input.

In another particular embodiment, compensation circuitry is used to reduce or nullify the effects of dielectric absorption of any particular capacitor by choosing a compensation capacitor with a higher rate of dielectric absorption and a lower capacitance value than the main capacitor whose dielectric absorption effects are to be nullified. The dielectric absorption of the compensation capacitor is scaled according to the two resistors in the compensation circuitry. An amplifier in the compensation circuitry performs an impedance transformation on the compensation capacitor, thereby canceling the dielectric absorption of the main capacitor.

In another particular embodiment, the main capacitor is not tied to ground. The dielectric absorption of the main capacitor is cancelled by a compensation capacitor with similar dielectric absorption. The dielectric absorption of the compensation capacitor is scaled according to the two resistors in the compensation circuitry. The dielectric absorption of the compensation capacitor is then used to compensate the dielectric absorption of the main capacitor by having the amplifier in the compensation circuitry perform an impedance transformation on the compensation capacitor. The result is that the dielectric absorption of the main capacitor is cancelled.

Figure 1A:
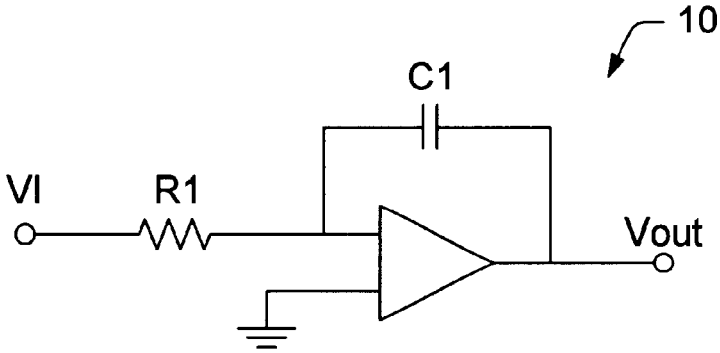
FIG. 1A (Prior Art)
FIG. 1A is a schematic of a basic Miller integrator according to the prior art.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE FIGURES

Figure 1B:
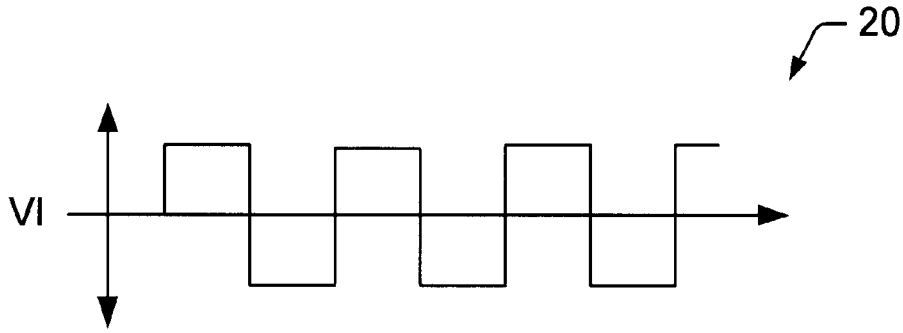
FIG. 1B (Prior Art)
FIG. 1B illustrates an input square wave applied to the Miller integrator.
Figure 1C:
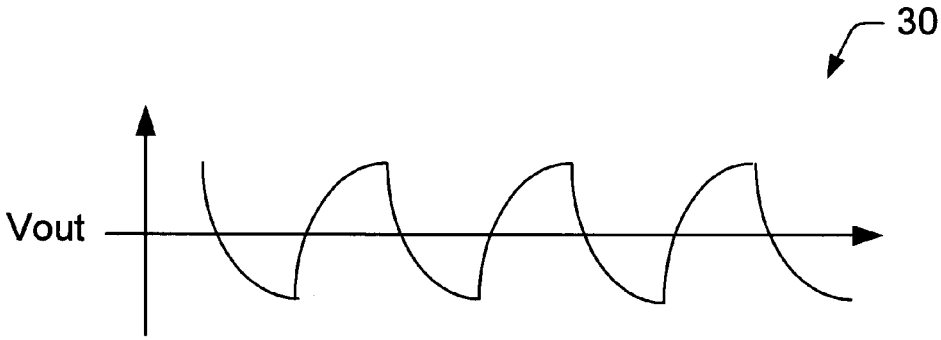
FIG. 1C (Prior Art)
FIG. 1C illustrates an output triangle wave exhibiting non-linearity due to the effects of dielectric absorption.

FIG. 1 illustrates the problem of dielectric absorption in the use of an integrator according to prior art. FIG. 1A illustrates a basic integrator circuit (Miller integrator) 10. The integrator 10 performs the mathematical function of integration on an input signal. FIG. 1B illustrates a square wave input signal 20. In one embodiment, square wave 20 is used as the input signal. A square wave, when mathematically integrated, produces a linear triangle wave (i.e. adds the area under the curve). Output waveform 30 shown in FIG. 1C represents the skewed triangle waveform that is created using a typical integrator circuit 10 without dielectric compensation.

Figure 2:
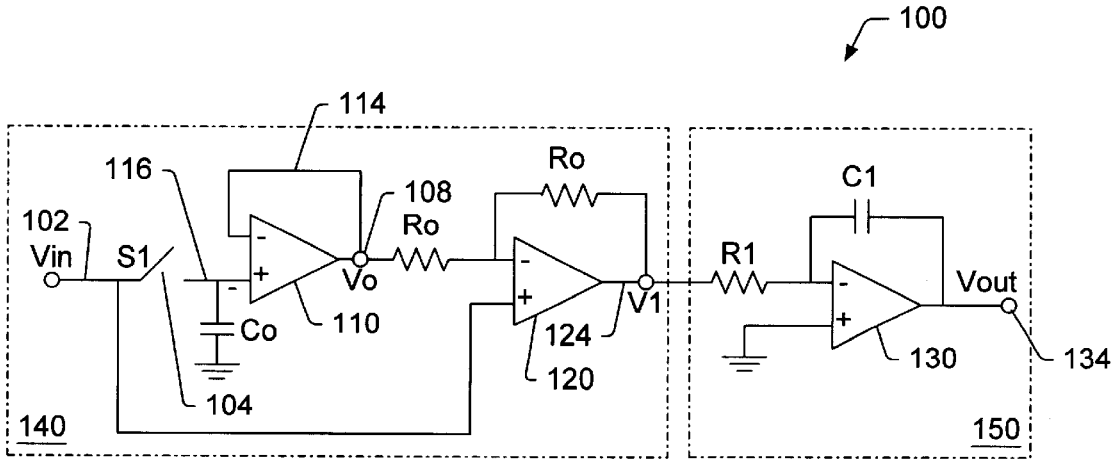
FIG. 2 is a schematic of one embodiment of the invention.

FIG. 2 illustrates one embodiment of the invention applied to an integrator circuit. The circuit of FIG. 2 is divided into two functional portions for ease of explanation: a compensation portion or compensation circuit 140 according to the present invention and an integration portion 150. The compensation portion 140 modifies the input signal 102 applied to the integration portion 150 to compensate for dielectric absorption in the capacitor C1. Thus, the integration portion 150 and the output signal 134 will suffer reduced effects from dielectric absorption. The integration portion 150 as shown in FIG. 2 is a typical Miller integrator and includes a capacitor C1.

The compensation circuit 140 includes an input port 102 for receiving an input voltage. The input voltage Vin may be a square wave signal. A switch 104 is coupled between input port 102 and input of amplifier 110. The switch 104 controls when the input signal 102 is provided to amplifier 110 and compensation capacitor Co. The compensation capacitor Co includes one plate connected to source 116 and a second plate connected to ground. Compensation capacitor Co may be substantially identical to capacitor C1 in level of capacitance. Once the switch 104 is closed, the compensation capacitor Co charges to the source voltage 102. The switch 104 is then opened. The voltage across the compensation capacitor Co will then initially decay. The decay is equal to the loss caused by the dielectric absorption of the compensation capacitor Co. Hence, the voltage across the compensation capacitor Co is now equal to the input signal voltage 102 minus the amount of voltage loss caused by the dielectric absorption. The source voltage at the source 116 of the amplifier 110 equals the voltage across the compensation capacitor Co, which is equal to the input signal voltage 102 minus the amount of voltage loss caused by the dielectric absorption. Feedback loop 114 contains no impedance in order to configure amplifier 110 in a unity gain configuration. This configuration results in the modified input signal 108 being equal to source 116. That is, the voltage at node 108 is equal to the voltage of the input signal 102 less the voltage loss caused by the dielectric absorption.

Amplifier 120 is configured in a subtracting configuration. In the illustrated embodiment, inputs of the amplifier 120 are the modified input signal 108 provided through resistor Ro and the input signal 102. Amplifier 120 produces a compensated input signal 124 that has a voltage value equal to twice the voltage value of the input signal 102 minus the voltage value of the modified input signal 108. Since the voltage of the modified input signal 108 is equal to the voltage of the input signal 102 minus the voltage loss caused by the dielectric absorption, the voltage of the compensated input signal 124 is equal to the voltage of the input signal 102 plus a dielectric absorption compensation voltage. In other words, the compensated input signal voltage 124 is equal to the input signal voltage plus the amount of voltage attributed to dielectric absorption compensation in the capacitor Co. Therefore, the compensation circuit 140 operates to receive an input signal Vin and produce a compensated input signal 124 which is equal to Vin plus a dielectric absorption compensation voltage.

The compensated input signal 124 is then input to the integrator portion 150 of the circuit. Since the capacitor C1 has similar dielectric absorption characteristics as the capacitor Co, the compensated input signal, which includes the input voltage plus a dielectric absorption compensation voltage, operates to reduce or remove the effects of dielectric absorption in the capacitor C1. The integration portion 150 of the circuit performs a mathematical integration function upon the compensated input signal. After integration, the resulting waveform 134 is a more linear triangle wave than could be achieved using an uncompensated square wave.

FIG. 3 illustrates the changes the Vin waveform encounters as it passes through the phases of the embodiment discussed above. These waveforms will be described in relationship to their operation in the embodiment of FIG. 2. FIG. 3A identifies the square wave signal 102 that is the input waveform of the circuit 100. FIG. 3B shows the status of switch 104 relative to the input signal 102. While the switch 104 is briefly in the closed position 310 the capacitor Co is charged to the level of input voltage 102. When the switch 104 is opened, the charge that was built up on capacitor Co supplies the input for the unity gain amplifier 110. The charge on capacitor Co will be affected by dielectric absorption, i.e. the measured charge will experience a gradual decay in voltage slightly below the input voltage 102 from which it was charged as shown in FIG. 3C. Because amplifier 110 is configured for unity gain, whenever switch 104 is open the voltage across capacitor Co is equal to output voltage 108. This output voltage can be seen graphically in FIG. 3C. Capacitor Co is preferably substantially identical in dielectric absorption characteristics to those of capacitor C1 and the two capacitors therefore may exhibit approximately the same amount of dielectric absorption. The output voltage 108 therefore is a representation of the amount of dielectric absorption voltage loss that will be exhibited by the capacitor C1.

Figure 3A:
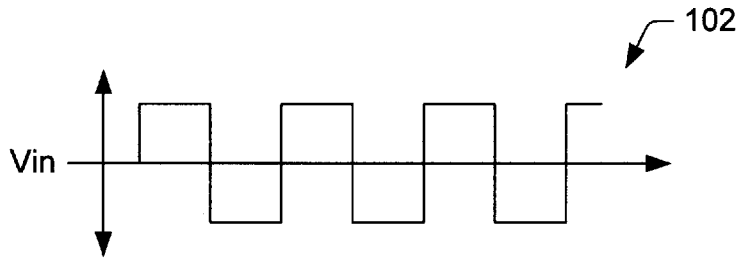
FIGS. 3A–E illustrate a series of waveforms illustrating changes made to a square wave input signal as it passes through the circuit of FIG. 2.
Figure 3B:
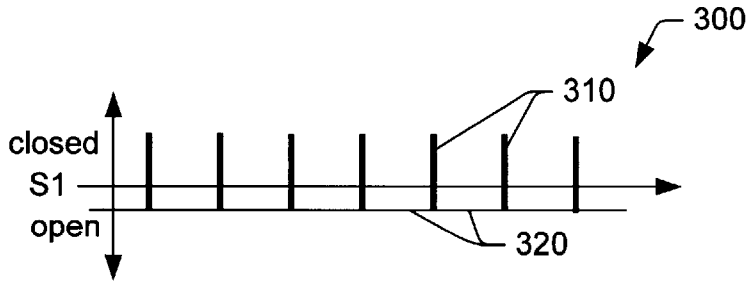
Figure 3C:
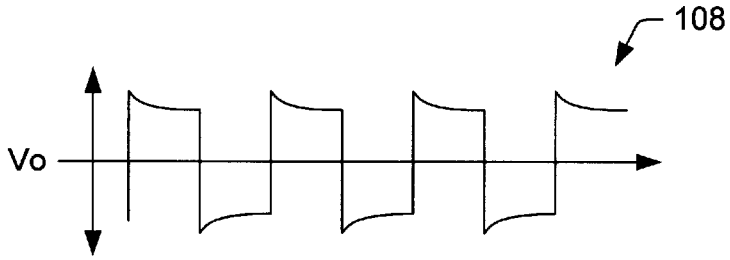
Figure 3D:
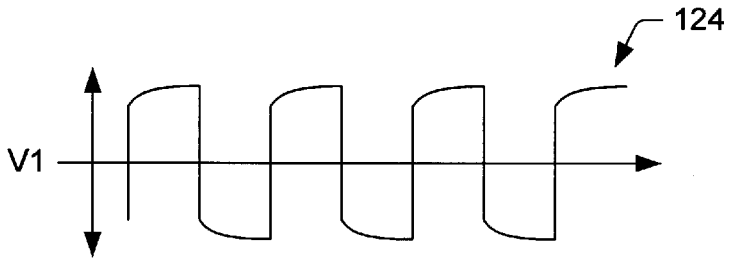

The modified input signal 108 is then received as an input to the subtractor amplifier 120. The other input to the subtractor amplifier 120 is the input voltage 102 that has not been altered by dielectric absorption or any other circuitry. The modified input signal 108 is subtracted from twice the initial signal 102, producing a compensated signal 124 that is equal to the initial input signal Vin 102 plus compensation due to dielectric absorption of capacitor Co. The compensated input signal is shown in FIG. 3D. The compensated input signal 124 has been compensated for the future dielectric absorption of capacitor C1 in the integration portion 150 of the circuit.

Figure 3E:
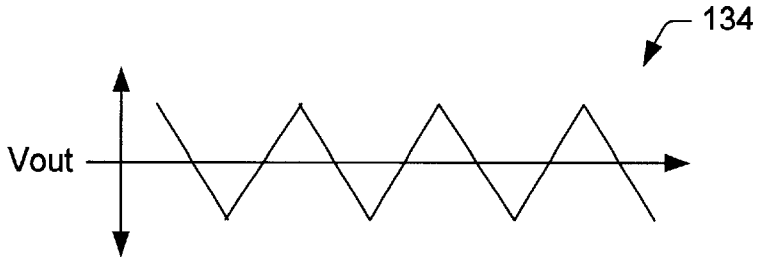

The compensated input signal 124 is then received at the input of amplifier 130. Amplifier 130 is configured with a feedback loop comprising capacitor C1. This configuration produces an integration effect on the input signal. Because the compensated input signal 124 has been increased by the amount of dielectric absorption of capacitor Co, the effect of dielectric absorption on capacitor C1 has been compensated. The result will be a more linear triangle wave than is possible without compensation as shown in FIG. 3E.

Figure 4:
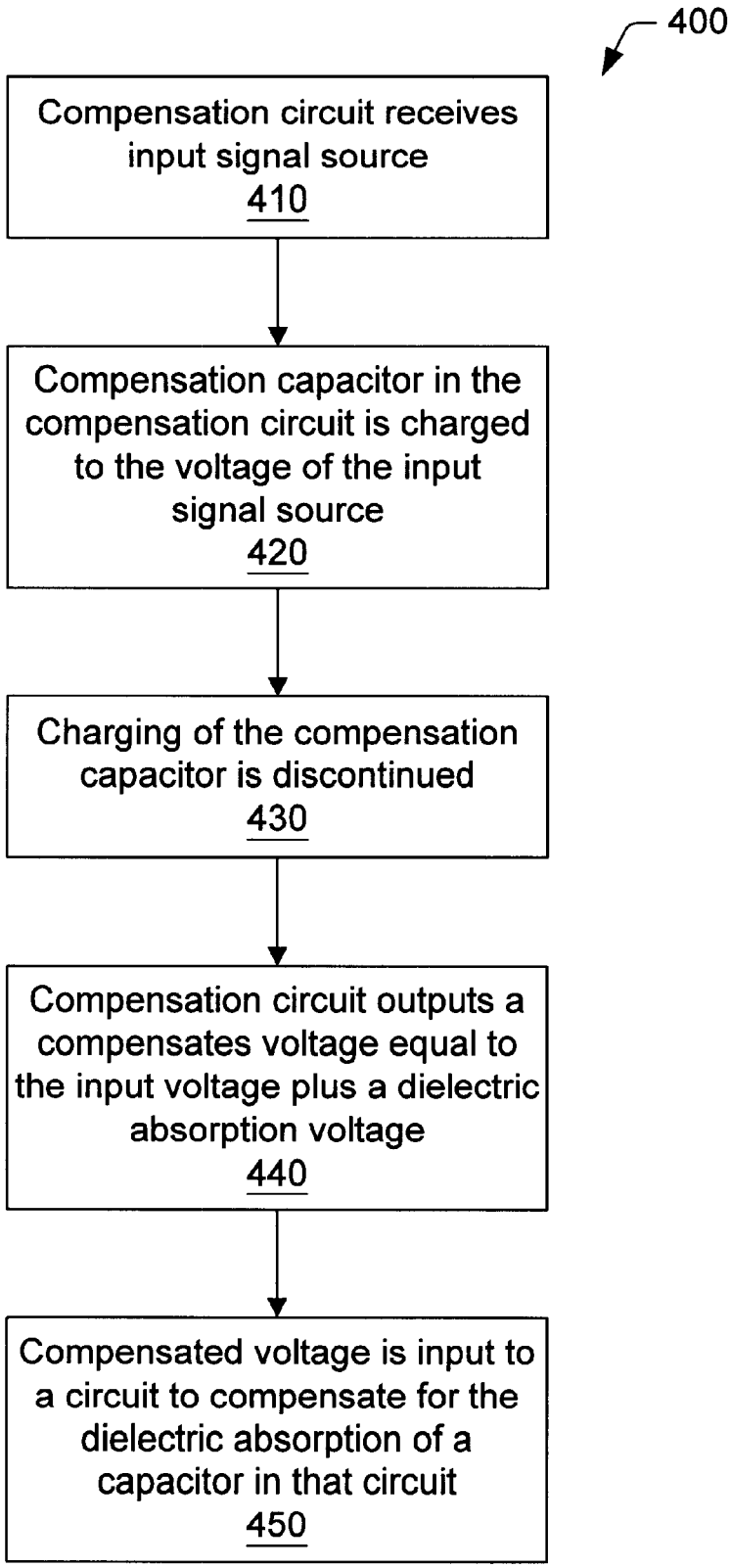
FIG. 4 is a flowchart illustrating one embodiment of the method of the invention.

FIG. 4 is a flowchart 400 depicting the steps in compensating the dielectric absorption of a first capacitor according to one embodiment.

In step 410, an input signal source such as a square wave is provided to the compensation circuit.

In step 420, a compensation capacitor in the compensation circuit with similar characteristics as the first capacitor is charged to the voltage of the input signal source. In step 430, the charging of the compensation capacitor is discontinued. The voltage across the compensation capacitor then loses an amount of voltage, referred to as the dielectric absorption voltage, due to dielectric absorption. The steps 420 and 430 are used to generate the dielectric absorption voltage.

In step 440, the compensation circuit outputs a compensated voltage equal to the input voltage plus a dielectric absorption voltage. In step 450, the compensated voltage is input to a circuit to compensate for the dielectric absorption of the first capacitor. For instance, the compensated voltage may be input to an integrator, such as a Miller integrator. Because the compensated capacitor has similar characteristics as the first capacitor, the compensated signal operates to reduce or remove the effects of the dielectric absorption of the first capacitor. Consequently, the output of the integrator produces a more linear triangle wave if the input signal source were a square wave.

Figure 5:
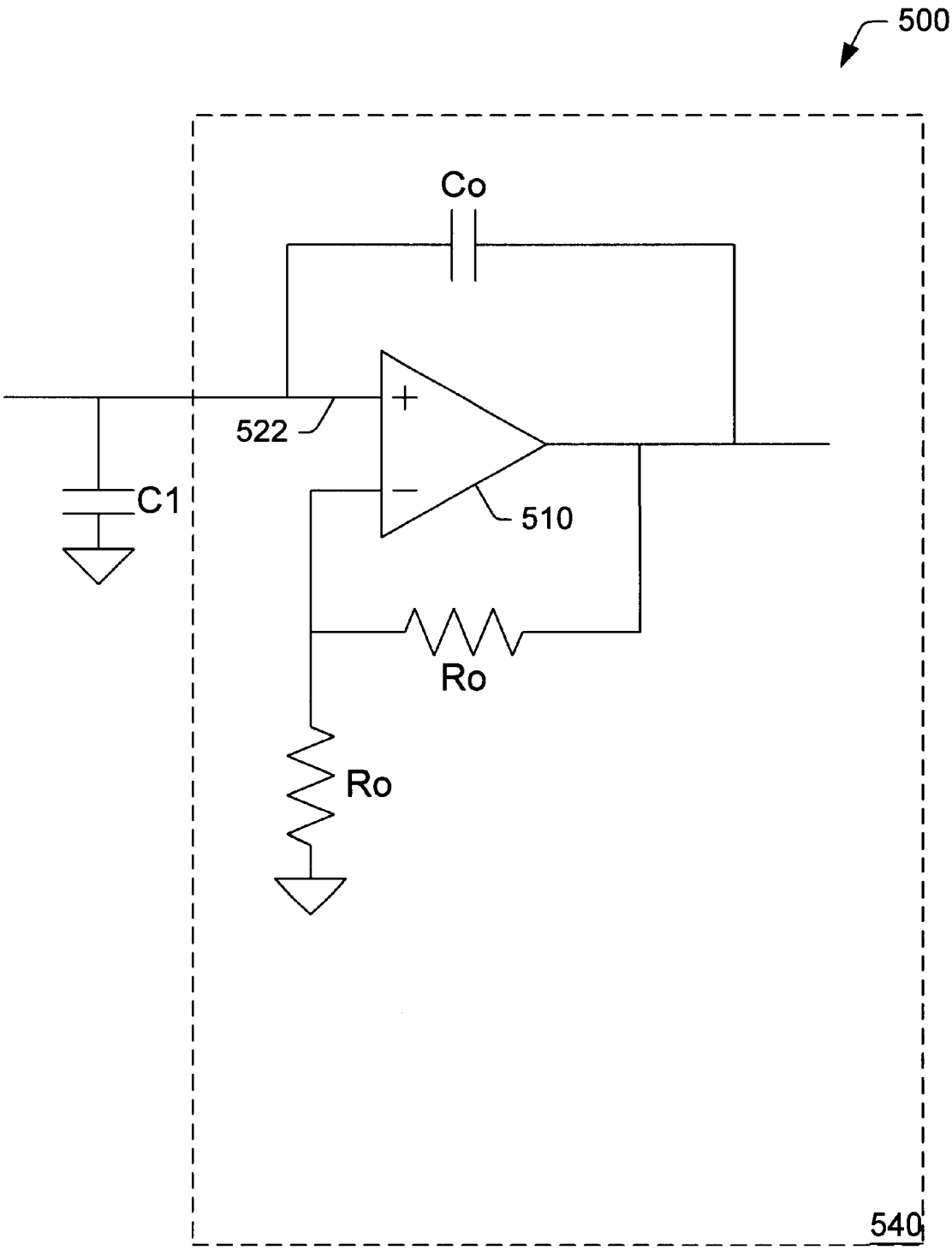
FIG. 5 illustrates one embodiment that substantially cancels the effects of dielectric absorption in a particular capacitor.

FIG. 5 illustrates another embodiment. In this embodiment a capacitor's dielectric absorption may be removed or eliminated through compensation circuitry 540. In this embodiment the compensation circuitry 540 is in parallel with the main capacitor C1, whose dielectric absorption is to be compensated. Because the capacitance of capacitors in parallel is the sum of their capacitances, the net capacitance of the circuit 500 is the value of the main capacitor C1 plus the value of the compensation circuitry 540. The amplifier 510 performs an impedance transformation on the compensation capacitor Co. This creates an equivalent of the inverse of the compensation capacitance (−Co) at input 522 of amplifier 510.

$$C_{total}=C1+\text{Compensation circuitry}$$

$$\text{Compensation circuitry}=-Co$$

$$C_{total}=C1-Co$$

This operation effectively subtracts the compensation capacitance from the main capacitance.

When selecting a compensation capacitor Co for use in this embodiment, a capacitor with a worse dielectric, i.e. a dielectric with a high dielectric absorption rate, than the main capacitor C1 is desired. The dielectric absorption of the compensating capacitor Co can be scaled according to the resistors Ro. This allows a compensating capacitor Co with substantially less capacitance along with a higher dielectric absorption rate as the main capacitor C1 to cancel the dielectric absorption of the main capacitor C1 while retaining a net circuit capacitance. The charge loss due to the dielectric absorption is a function of both the dielectric absorption rate and the amount of capacitance. Therefore, the charge loss due to the dielectric absorption can be approximately the same for both the compensating capacitor Co and the main capacitor C1. The amplifier in the compensation circuitry 540 then performs an impedance transformation on the compensation capacitor Co canceling the dielectric absorption of the main capacitor C1. The impedance of the parallel combination of the main capacitor C1 and the compensation circuitry 540 approximately equals the impedance of an ideal capacitor without dielectric absorption. It is noted that the compensation circuitry 540 in FIG. 5 may be used to perform dielectric compensation of any particular capacitor.

Figure 6:
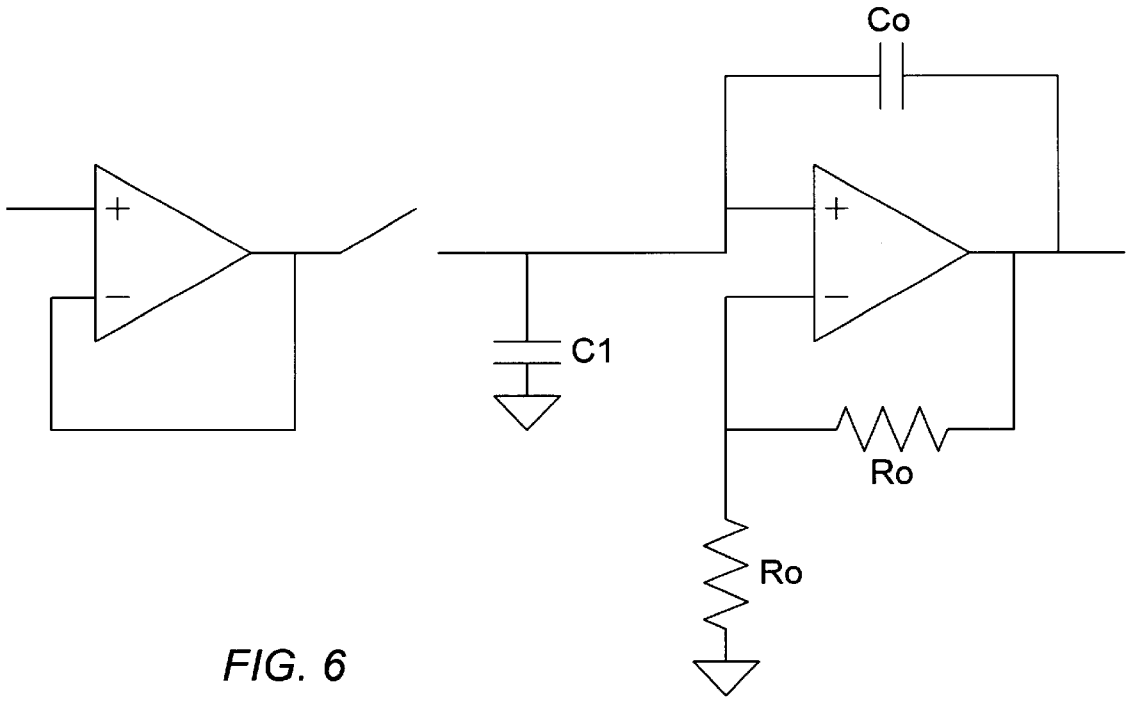
FIG. 6 illustrates an application of the embodiment of FIG. 5.

FIG. 6 shows one application of the embodiment of FIG. 5. FIG. 6 illustrates a track and hold circuit using the dielectric cancellation technique shown in FIG. 5. Track and hold circuits are especially sensitive to dielectric absorption. The cancellation technique as shown in FIG. 5 solves the dielectric absorption problem more effectively and simply than prior techniques based on the modeling of the dielectric absorption as a collection of resistor-capacitor (RC) networks.

In the track and hold circuit of FIG. 6, dielectric absorption is a concern only during the hold phase. That is, while the circuit is tracking the input, the voltage across the main capacitor C1 will be equal to the input voltage. However, once the track and hold circuit switches to the hold phase, i.e. the switch opens, the voltage across the main capacitor C1 will start to drift due to dielectric absorption. However, when the embodiment of FIG. 5 is used to cancel the dielectric absorption of the main capacitor C1, the voltage across the main capacitor C1 is held at the sampled input voltage.

Figure 7:
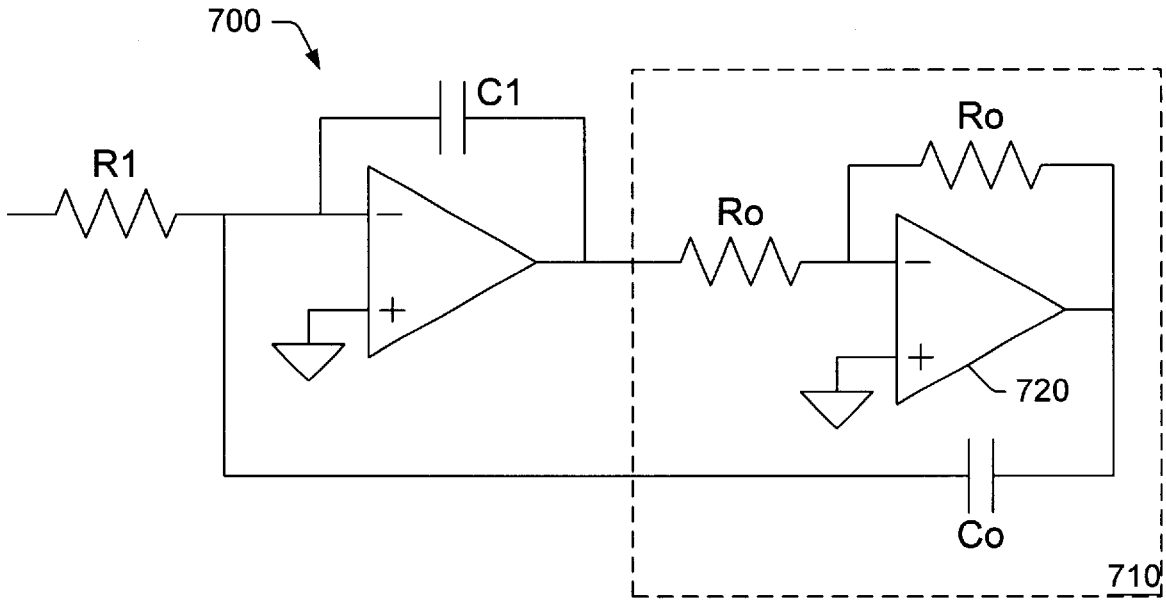
FIG. 7 illustrates one embodiment that substantially cancels the effects of dielectric absorption in a particular capacitor that is not connected to ground.
Figure 8A:
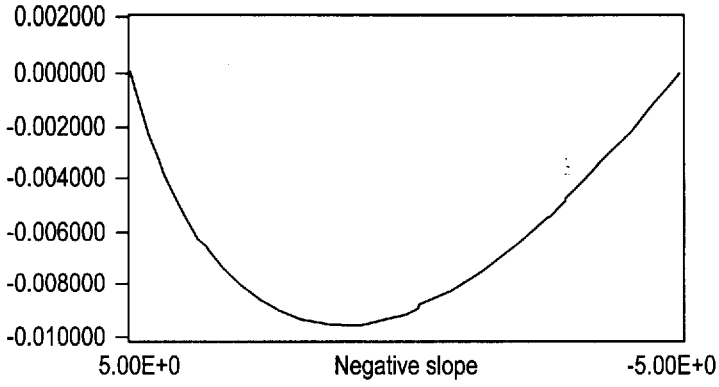
FIG. 8 is a set of experimental data comparing linearity of integrator outputs with and without dielectric absorption compensation.
Figure 8B:
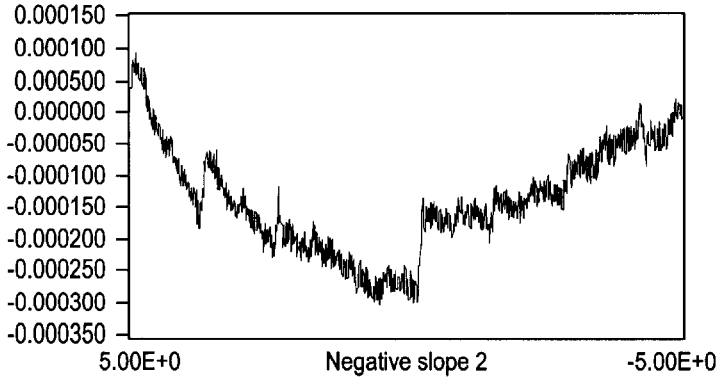
Figure 8C:
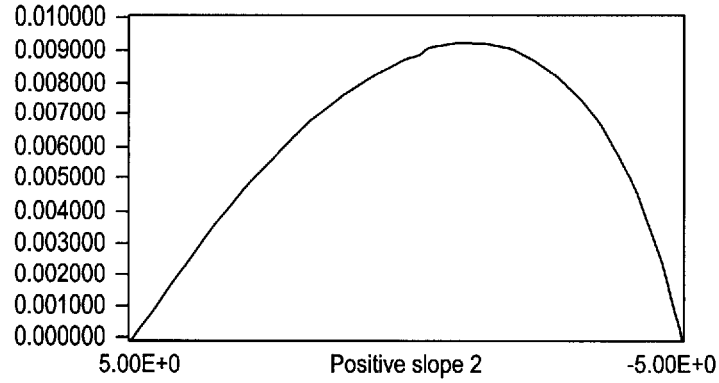
Figure 8D:
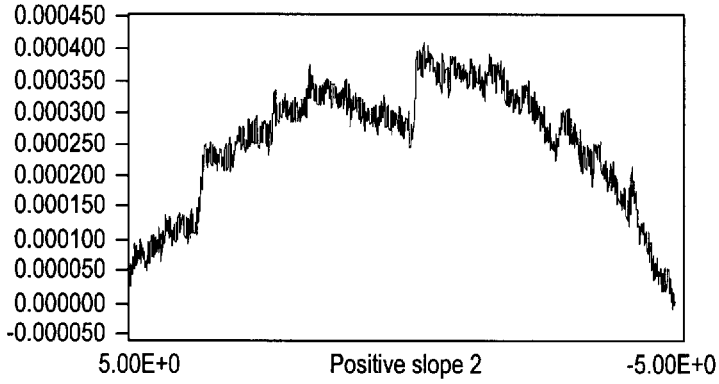

FIG. 7 illustrates an embodiment 700 that produces the same effects as those discussed in FIG. 5. Compensation circuitry 710 comprises a compensating capacitor Co and an inverting amplifier 720. The amplifier 720 effectively subtracts the capacitance of compensating capacitor Co from the capacitor to be compensated, referred to as the main capacitor C1. The embodiment of FIG. 7 differs from the embodiment of FIG. 5 in that the main capacitor C1 is not tied to ground and is in the negative feedback of an integrator. In order to cancel the dielectric absorption of the main capacitor C1, the dielectric absorption of the compensating capacitor Co may be equal to the dielectric absorption of the main capacitor C1. The dielectric absorption of the compensating capacitor Co can be scaled according to the resistors Ro. These resistors Ro control the gain of the amplifier 720 in the compensation circuit. The amplifier 720 in the compensation circuitry then performs an impedance transformation on the compensation capacitor Co canceling the dielectric absorption of the main capacitor C1. Once the dielectric absorption of the main capacitor C1 has been compensated by the dielectric absorption of the compensating capacitor Co, the net impedance of the parallel combination of the main capacitor C1 and the compensation circuitry 710 approximately equals the impedance of an ideal capacitor without dielectric absorption.

FIG. 8 illustrates experimental results of the dielectric compensation as described in the preferred embodiment of FIG. 2. FIGS. 8A–8D plot signal deviations from a straight line during one half cycle of the output triangle wave. The triangle wave had a frequency of 20 Hz with a cycle of 5 ms. FIGS. 8A and 8C illustrate the negative and positive slope, respectively, of the output signal 134 of an uncompensated Miller integrator 10. The respective graphs show a maximum deviation from a linear line of approximately 9.8 mv on both uncompensated signals 8A and 8C. FIGS. 8B and 8D illustrate the negative and positive slope, respectively, of the output signal 134 of the compensated circuit of FIG. 2. FIG. 8B, showing the negative slope, shows a maximum deviation from a linear line of approximately 0.3 mv, while FIG. 8D, showing the positive slope, shows a maximum deviation from a linear line of approximately 0.4 mv. These results illustrate that the compensation circuitry reduces an output signal's nonlinearity by a factor of 30 in the negative slope and a factor of 23 in the positive slope.

Prior art used resistor-capacitor (RC) networks to solve the dielectric absorption problem. However, one major disadvantage of RC networks is that it takes many empirically-chosen parallel RC networks to effectively compensate for dielectric absorption over a wide range of times. Therefore, the present invention yields both better results and simpler circuits than the prior art.

Although the system and method of the present invention has been described in connection with the preferred embodiments, it is not intended to be limited to the specific forms set forth herein, but on the contrary, it is intended to cover such alternatives, modifications, and equivalents, as can be reasonably included within the spirit and scope of the invention as defined by the appended claims.

What is claimed is:

1. A compensating circuit which compensates for dielectric absorption of a first capacitor in a first circuit, comprising:

a signal source for receiving an input voltage;

a switch coupled to the signal source;

a compensating capacitor coupled to the switch, wherein the compensating capacitor has similar dielectric absorption characteristics of the first capacitor, wherein the compensating capacitor is used in generating a dielectric absorption voltage;

one or more amplifiers coupled to the compensating capacitor, wherein the one or more amplifiers are operable to output a compensated voltage which is equal to the input voltage plus the dielectric absorption voltage;

wherein the compensated voltage is input to the first circuit to compensate for dielectric absorption of the first capacitor in the first circuit.

2. The circuit of claim 1, wherein the absorption voltage corresponds to the dielectric absorption exhibited by the compensating capacitor.

3. The circuit of claim 1, wherein the compensating capacitor charges to the input voltage when the switch is closed, wherein the compensating capacitor decays by an amount of the dielectric absorption when the switch is opened, resulting in a voltage equal to the input source voltage less dielectric absorption voltage.

4. The circuit of claim 3, wherein the one or more amplifiers includes a first amplifier in a unity gain configuration coupled to the compensating capacitor.

5. The circuit of claim 4, wherein the first amplifier in a unity gain configuration produces an output voltage that equals the input voltage less dielectric absorption voltage.

6. The circuit of claim 4, wherein the one or more amplifiers includes a second amplifier in a subtraction configuration coupled to the first amplifier in a unity gain configuration.

7. The circuit of claim 6, wherein the second amplifier in a subtraction configuration produces an output voltage that equals the input voltage plus the dielectric absorption voltage.

8. The circuit of claim 1, wherein the first circuit is an integrating circuit, wherein the compensated voltage is input to the integrating circuit, wherein the integrating circuit includes the first capacitor that is compensated.

9. A compensating circuit which compensates for dielectric absorption of a first capacitor, comprising:

a signal source for receiving an input voltage;

a switch coupled to the signal source;

a first amplifier coupled to the switch;

a compensating capacitor coupled to an input of the first amplifier, wherein the compensating capacitor has similar dielectric absorption characteristics of the first capacitor, wherein the compensating capacitor is used in generating a dielectric absorption voltage;

wherein the first amplifier generates a first voltage equal to the input voltage less a dielectric absorption voltage;

a second amplifier coupled to the first amplifier and the signal source, wherein the second amplifier outputs a compensated voltage which is equal to the input voltage plus the dielectric absorption voltage.

10. The circuit of claim 9, wherein the first amplifier is in a unity gain configuration.

11. The circuit of claim 9, wherein the second amplifier is in a subtraction configuration.

12. The circuit of claim 9, wherein the compensating circuit is coupled to an integrating circuit, wherein the compensating circuit outputs the compensated voltage to the integrating circuit.

13. The circuit of claim 12, wherein the integrating circuit comprises the first capacitor with similar dielectric absorption characteristics as the compensating capacitor in the compensating circuit, wherein the first capacitor's dielectric absorption is compensated by the compensating circuit.

14. A compensating circuit which compensates for dielectric absorption of a first capacitor in a first circuit, wherein the first capacitor exhibits dielectric absorption, wherein the compensating circuit is coupled to an input of the first circuit, wherein the compensating circuit receives an input voltage desired to be applied to the first circuit, wherein the compensating circuit includes a compensating capacitor which has similar dielectric absorption characteristics of the first capacitor, wherein the compensating capacitor is used in generating a dielectric absorption voltage, wherein the compensating circuit is operable to output a compensated voltage which is equal to the input voltage plus the dielectric absorption voltage, wherein the compensated voltage is input to the first circuit to compensate for the dielectric absorption of the first capacitor in the first circuit.

15. A circuit, comprising:

a first circuit having a first capacitor, wherein the first capacitor exhibits dielectric absorption;

a compensating circuit coupled to an input of the first circuit which compensates for dielectric absorption of the first capacitor in the first circuit, wherein the compensating circuit receives an input voltage desired to be applied to the first circuit, wherein the compensating circuit portion includes a compensating capacitor which has similar dielectric absorption characteristics of the first capacitor to be compensated;

wherein the compensating circuit portion is operable to output a compensated voltage which is equal to the input voltage plus a dielectric absorption voltage, wherein the compensated voltage is input to the first circuit to compensate for dielectric absorption of the first capacitor in the first circuit.

16. The circuit of claim 15, wherein the compensating capacitor is used in generating the dielectric absorption voltage.

17. The circuit of claim 15, wherein the first circuit portion is an integrating circuit.

18. The circuit of claim 15, wherein the output voltage of the compensating circuit is equal to the input voltage of the first circuit.

19. The circuit of claim 15, wherein the compensating circuit comprises an amplifier in a unity gain configuration coupled to the compensating capacitor, wherein the output of the amplifier in a unity gain configuration is equal to the input voltage of the compensating circuit less the dielectric absorption voltage.

20. The circuit of claim 19, wherein the compensating circuit comprises an amplifier in a subtraction configuration coupled to the output of the amplifier with a unity gain configuration, wherein the output of the amplifier in a subtraction configuration is equal to the input voltage of the compensating circuit plus the dielectric absorption voltage.

21. A method for compensating for dielectric absorption of a first capacitor in a circuit, the method comprising:

receiving an input voltage;

charging a compensating capacitor with the input voltage, wherein the compensating capacitor has similar dielectric absorption characteristics of the first capacitor to be compensated;

discontinuing charging the compensating capacitor;

wherein the compensating capacitor loses a dielectric absorption voltage due to dielectric absorption after said discontinuing charging the compensating capacitor;

outputting a compensated voltage which is equal to the input voltage plus the dielectric absorption voltage;

wherein the compensated voltage is input to the circuit to compensate for dielectric absorption of the first capacitor in the circuit.

22. The method of claim 21, further comprising:

closing a switch, wherein said closing begins said charging the compensating capacitor, wherein the compensating capacitor is charged to a voltage level equal to the input voltage.

23. The method of claim 22, further comprising:

wherein said discontinuing charging the compensating capacitor comprises opening the switch, wherein after the opening the switch the voltage across the compensating capacitor decays by an amount of the dielectric absorption, wherein the voltage of the compensating capacitor equals the input voltage less the dielectric absorption voltage.

24. The method of claim 23, further comprising:

inputting the voltage across the compensating capacitor to a first amplifier with a unity gain configuration, wherein the output of the first amplifier equals the input voltage less the dielectric absorption voltage.

25. The method of claim 24, further comprising:

coupling the output of the first amplifier to a second amplifier with a subtraction configuration, thereby producing the compensated voltage.

26. The method of claim 25, further comprising:

coupling the output of the second amplifier to an input of an integrating circuit, wherein the integrating circuit produces an output with a voltage equal to the input voltage after compensating for the dielectric absorption of the first capacitor in the integrating circuit.

27. A circuit which compensates for dielectric absorption of a main capacitor, comprising:

the main capacitor;

compensation circuitry in parallel to the main capacitor, wherein the compensation circuitry comprises a compensation capacitor with a higher dielectric absorption rate as the main capacitor, wherein the dielectric absorption of the compensation capacitor is used to compensate for the dielectric absorption of the main capacitor.

28. The circuit of claim 27, wherein the compensation circuitry further comprises:

a first amplifier with the compensation capacitor in a positive feedback loop, wherein the first amplifier performs an impedance transformation on the compensation capacitor.

29. The circuit of claim 28, wherein the compensation circuitry further comprises:

a first resistor in a negative feedback loop of the first amplifier; and a second resistor coupled between ground and a negative input of the first amplifier.

30. The circuit of claim 29, wherein the net capacitance of the circuit is equal to the capacitance of the main capacitor less the scaled capacitance of the compensation capacitor.

31. The circuit of claim 29, wherein the dielectric absorption of the main capacitor is cancelled by the dielectric absorption of the compensation capacitor by the first amplifier performing an impedance transformation on the compensation capacitor, wherein the impedance of the parallel combination of the main capacitor and the compensation circuitry approximates the impedance of an ideal capacitor without dielectric absorption.

32. The circuit in claim 29, wherein the input of the circuit is coupled to a second amplifier to form a track and hold circuit using the compensated capacitance of the main capacitor.

33. A circuit which compensates for dielectric absorption of a main capacitor, comprising:

the main capacitor in a negative loop of a first amplifier with an inverting configuration; and compensation circuitry in parallel to the main capacitor, wherein the compensation circuitry comprises a compensation capacitor, wherein the compensation capacitor has a dielectric absorption approximately equal to the dielectric absorption of the main capacitor, wherein the dielectric absorption of the compensating capacitor is used in compensating for the dielectric absorption of the main capacitor.

34. The circuit in claim 33, wherein the compensation circuitry further comprises:

a second amplifier with an inverting configuration, wherein the compensation capacitor is coupled between an output of the second amplifier and an input of the first amplifier, wherein the second amplifier performs an impedance transformation on the compensation capacitor.

35. The circuit in claim 34, wherein the value of the dielectric absorption of the compensation capacitor is dependent on the gain of the second amplifier.

36. The circuit in claim 34, wherein the dielectric absorption of the main capacitor is cancelled by the dielectric absorption of the compensation capacitor by the second amplifier performing an impedance transformation on the compensation capacitor, wherein the impedance of the parallel combination of the main capacitor and the compensation circuitry approximates the impedance of an ideal capacitor without dielectric absorption.

37. The circuit in claim 34, wherein the net capacitance of the circuit is equal to the capacitance of the main capacitor less the scaled capacitance of the compensation capacitor.

* * * * *